US006550223B2

(12) United States Patent
Xiong et al.

(10) Patent No.: US 6,550,223 B2
(45) Date of Patent: Apr. 22, 2003

(54) EVACUATABLE, HEAT SEALABLE PACKAGE AND METHOD OF USING THE SAME

(75) Inventors: Yan Xiong, Bradenton, FL (US); Cullen M. Sabin, Cortez, FL (US)

(73) Assignee: Tempra Technology Inc., Bradenton, FL (US)

( * ) Notice: Subject to any disclaimer, the term of this patent is extended or adjusted under 35 U.S.C. 154(b) by 0 days.

(21) Appl. No.: 09/798,634

(22) Filed: Mar. 2, 2001

(65) Prior Publication Data

US 2001/0034999 A1 Nov. 1, 2001

Related U.S. Application Data

(60) Provisional application No. 60/186,466, filed on Mar. 2, 2000.

(51) Int. Cl.[7] ..... B65B 31/04
(52) U.S. Cl. ..... 53/434; 53/405
(58) Field of Search ..... 53/434, 512, 133.1, 53/79, 405; 383/94, 904, 103

(56) References Cited

U.S. PATENT DOCUMENTS

| | | | | |
|---|---|---|---|---|
| 4,067,765 A | | 1/1978 | Heller, Jr. et al. | |
| 4,069,349 A | | 1/1978 | Shaw | |
| 4,513,015 A | | 4/1985 | Clough | |
| 4,683,702 A | | 8/1987 | Vis | |
| 4,756,140 A | | 7/1988 | Gannon | |
| 4,903,841 A | | 2/1990 | Ohsima et al. | |
| 4,941,310 A | | 7/1990 | Kristen | |
| 5,121,996 A | | 6/1992 | Scarrow | |
| 5,187,917 A | | 2/1993 | Mykleby | |
| 5,220,768 A | | 6/1993 | Aarts | |
| 5,239,808 A | | 8/1993 | Wells et al. | |
| 5,272,856 A | | 12/1993 | Pharo | |
| 5,351,463 A | | 10/1994 | Aarts | |
| 5,388,910 A | * | 2/1995 | Koyanagi | 383/103 |
| RE34,929 E | | 5/1995 | Kristen | |
| 5,501,525 A | | 3/1996 | Cox et al. | |
| 5,551,213 A | | 9/1996 | Koelsch et al. | |
| 5,564,260 A | | 10/1996 | West et al. | |
| 5,598,684 A | | 2/1997 | Aarts | |
| 5,711,136 A | | 1/1998 | Carcano | |
| 5,791,123 A | | 8/1998 | Bolz | |
| 5,900,299 A | | 5/1999 | Wynne | |
| 5,976,317 A | | 11/1999 | Podsiadlo et al. | |

FOREIGN PATENT DOCUMENTS

| | | |
|---|---|---|
| EP | 0 665 622 A1 | 8/1995 |

* cited by examiner

*Primary Examiner*—Stephen F. Gerrity
(74) *Attorney, Agent, or Firm*—Fish & Richardson P.C.

(57) ABSTRACT

Vacuum packaging methods and materials are claimed. The materials are fusible and can form a part of a heat seal closure for non-rigid and semi-rigid packages. The methods are suitable for packages containing materials generally, and are well suited for those containing granular materials.

7 Claims, 2 Drawing Sheets

EVACUATABLE, HEAT SEALABLE PACKAGE AND METHOD OF USING THE SAME

This application claims the benefit of U.S. Provisional Application No. 60/186,466, filed Mar. 2, 2000, now expired.

FIELD OF THE INVENTION

The invention relates to vacuum packaging of materials, and methods for accomplishing such packaging. Specifically, the invention relates to the vacuum packaging of materials in semi-rigid or non-rigid packaging which can be heat sealed.

BACKGROUND OF THE INVENTION

Vacuum packaging is useful for the isolation of a material from the environment for definite or indefinite periods of time. This isolation may be desirable because the packaged material is sensitive to environmental conditions, or because the material is to be used in a process which must be isolated from the environment.

For example, some of the useful applications for vacuum packaging are for foodstuffs, medical materials, pharmaceutical applications, electronic components, and a wide variety of air-, oxygen-, or moisture-sensitive materials.

There are packaging applications in which it is desirable to be able to draw a vacuum on the contents of a flexible bag and then seal the bag against the introduction of air. A convenient method of sealing such bags is by heat sealing. One such application is in home food packaging, for example. Several systems are commercially available which allow the individual to draw the air out of a bag and then provide a seal against further air intrusion. For example, U.S. Pat. No. RE 34,929 to Kristen, and U.S. Pat. No. 4,941,310 to Kristen are representative. In these systems, the manufacturer's packaging material must be used, since that material is specially configured to allow air to flow to the vacuum pump inlet inside the bag while the atmospheric pressure on the outside of the bag squeezes the top and bottom panels of the bag tightly together. In order to provide this flow passage, the bag material is corrugated, quilted, or otherwise provided with macroscopic channels. The panels of the plastic film must be stiff enough to support the "vacuum flow" channels against the external loads.

One successful consumer-use vacuum packaging/heat sealing system is known as Foodsaver (Tilia Inc., San Francisco, USA). This system employs a bag with the inner face of one bag panel quilted into a diamond pattern. The pattern is self-supporting to the extent that a passage is always provided between the upper and lower faces to allow evacuation, even when the opposing panels are brought together by the forces of vacuum.

There are many potential applications for vacuum packaging for which no quilted materials are available. The success of the vacuum package depends on the ability to draw air from the packaged material, between smooth materials, and out across the location of the final seal. Unfortunately, panels of smooth film, when subjected to external pressure, press tightly against each other, effectively blocking further flow of trapped air toward the pump orifice.

Other prior art processes use a device known as a snorkel to place a vacuum source within an unsealed semi-rigid or non-rigid package, so that withdrawal of the atmosphere within the package can be accomplished with application of a vacuum to the snorkel. The panels of the bag tend not to collapse to the extent of preventing the escape of air when a snorkel is used. Complete sealing of the bag, by such means as heat sealing, is then carried out. The snorkel can be withdrawn from the bag essentially instantaneously with the sealing operation, but this method does not achieve as high a vacuum as is possible otherwise. The snorkel can also be left in the bag, to be retrieved after another seal is made between the trapped snorkel and the material in the bag. Some representative snorkel-type devices and methods have been described in U.S. Pat. No. 5,711,136 to Carcano, U.S. Pat. No. 5,551,213 to Koelsch et al., and U.S. Pat. No. 5,501,525 to Cox et al.

SUMMARY OF THE INVENTION

The invention results from a realization that semi-rigid or non-rigid packages which are to be evacuated is more efficiently evacuated when a duct of fusible material extends into an unsealed package, a vacuum drawn through the duct, and the package sealed without removing the duct. The duct can be sealed into the package and can partially or wholly form the seal of the package. Before sealing, the duct provides a passage for the withdrawal of atmosphere from the package, and the passage does not collapse upon the application of vacuum to the package. This can be a problem, particularly if the interior walls of the package are smooth. The duct can be made of material that prevents or greatly inhibits the undesired removal of substances in the package, such as can occur during the vacuum sealing of packages containing granular substances.

In general, the invention provides a method of evacuating a package. The method includes providing an unsealed semi-rigid or non-rigid package with a duct including fusible material. The package includes an upper panel and a lower panel, and between these is an interior region. The panels are heat sealable at their peripheries to form a fluid-tight barrier between the interior region and the external environment. The duct includes an internal end and an external end. The internal end is inserted into the interior region of the package, and the external end is in association with a vacuum source external to the package. The internal end of the duct can extend as far into the package as necessary to allow the vacuum source to effectively remove atmosphere from the package interior. The extent to which the duct must be inserted into the package may depend on the characteristics of the inner surfaces of the upper and lower panels, or the nature of any material within the package interior. The method also includes drawing a vacuum on the interior region of the package by applying vacuum to the external end of the duct; and the method includes heat sealing the unsealed portion of the periphery of the package, without removing the duct, to provide a fluid-tight barrier between the interior region of the package and the external environment. Optionally, the package can have a fluid tight seal around between about 50 and 99% of its periphery, or around between about 75 and 99% of its periphery. Further optionally, the package can be sealed around its periphery, except for the portion of the periphery overlapped by the duct.

The fusible material can be woven or non-woven fabric, open cell foam, paper, or fiber sheet. The interior region of the package can be at least partially filled with granular material. The package can be made from a material such as coated cellophane, cellulose acetate, coated polyester, poly (chlorotrifluoroethylene), polyethylene, polystyrene, polyvinyl alcohol, nonrigid polyvinyl chloride and copolymers thereof, polyvinyl chloride-nitrile rubber blend, polyvinylidene chloride, rubber hydrochloride, fluorinated ethylene-propylene copolymer, flexible vinyl, or SURLYN thermoplastic ionomer-lined multi-layer film.

In another aspect, the invention provides a vacuum packaging aid including a duct of fusible material having an internal end and an external end. The internal end extends into an interior region of an unsealed semi-rigid or non-rigid package, and the external end is in association with a vacuum source. The fusible material can be woven or non-woven fabric, open cell foam, paper, or fiber sheet.

In a further aspect, the invention provides a method of evacuating a package. The method includes providing an unsealed semi-rigid or non-rigid package with a duct. The package includes upper and lower panels, between which is an interior region. The panels are heat sealable to form a fluid-tight barrier between the interior region and the external environment. The duct includes an internal end and an external end, the internal end being inserted into the interior region of the package, and the external end being in association with a vacuum source external to the package. The method further includes drawing a vacuum on the interior region of the package by applying vacuum on the external end of the duct. The invention further includes sealing the package, so that the duct forms at least part of a fluid-tight barrier between the interior region of the package and the external environment.

As used in the claims, the term "macroscopic passage" refers to a passage through a duct that does not require passage of gas through the walls of the duct, or the substance of the duct itself. Rather gas is evacuated through a void in the duct which is larger than any void which may exist in the material comprising the duct walls.

As used the in claims, the term "granular material" refers to a particulate substance with particles of size no larger than approximately 5 mm in diameter. The lower size limit of the particulate substance can be, but is not necessarily, limited by the material used as a fusible duct, or alternately the size of a macroscopic passage formed with the duct. Granular material can include highly pulverized material with very small diameters. The particles need not be of any particular shape, but can be spherical, roughly spherical, cubic, or non regular in shape.

As used in the claims, the term "heat sealing" refers to the bonding or welding of a material to itself or to another material by the use of heat. This can be done with or without the use of adhesive, depending on the nature of the materials.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

DETAILED DESCRIPTION

Figure 1:
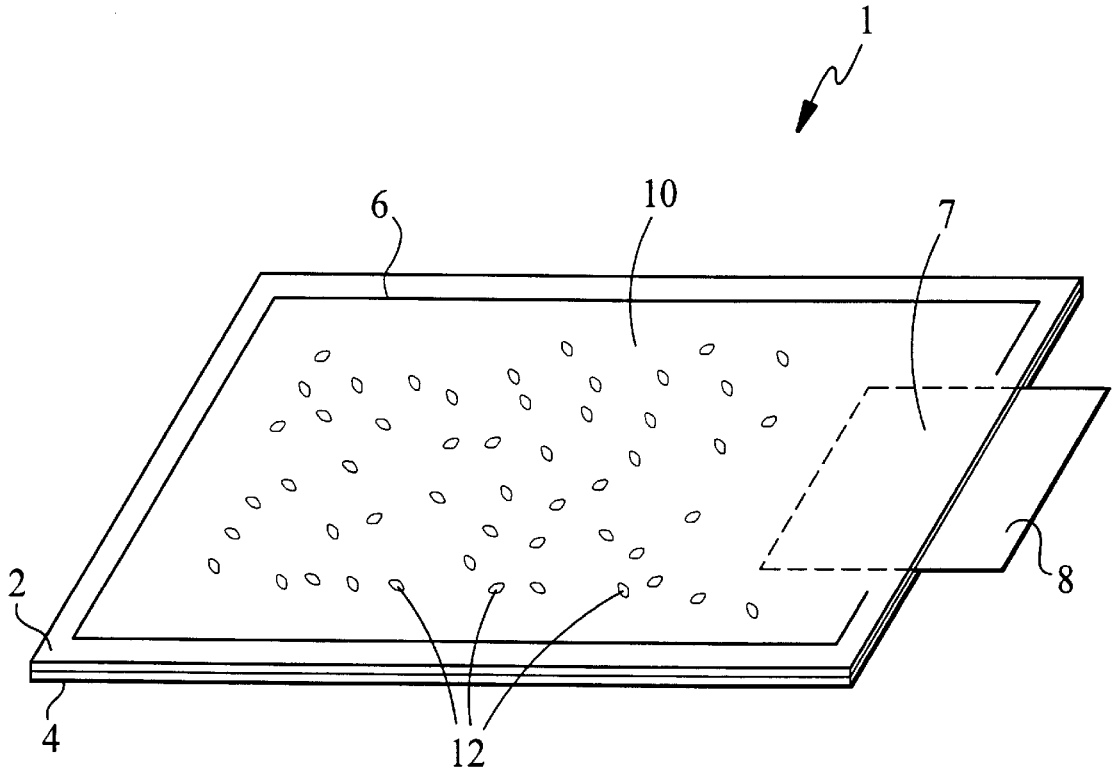
FIG. 1 is a perspective view of an unsealed package equipped with a vacuum packaging aid according to a particular embodiment of the invention.

The invention includes a method for evacuating and heat sealing semi-rigid and non-rigid packages, using a duct of fusible material which extends into the packaging before it is heat sealed, drawing the packaging atmosphere from the package through the duct, and heat sealing the package without removing the duct from the package. This is possible because the fusible material can form part of the package seal upon heat sealing. The package can be empty of material, or can be partially or substantially completely filled with solid or liquid material. In preferred embodiments, the method is carried out on packages at least partially filled with solid material. In particularly preferred embodiments, the method is carried out on packages at least partially filled with granular material.

The material which can serve as the fusible duct material has several requirements. It must be able to form part of the package heat seal. Preferably, when the fusible material does form part of the package seal, it does not reduce the performance of that seal.

The fusible duct must allow the free flow of gases from the bag interior to the vacuum source before the sealing of the package. This requirement can be achieved by virtue of the shape of the duct. One example of a duct structure which allows free gas flow is that of a rectangular prismatic duct or a cylindrical duct with a macroscopic passage through the length of the duct. In such cases, the duct should be outfitted with a filter of some kind, if the duct is to be used for evacuating packages containing powdered materials. The requirement that the duct be made of fusible material remains in effect. Thus, the heat sealing of package with a duct having a macroscopic passage as described would involve the closure of the passage, for example by the collapse of the duct walls in the heat sealing step.

The requirement of allowing free gas flow can also be achieved by virtue of the nature of the material comprising the duct. In such preferred embodiments, for example, the fusible duct can be comprised of a material having a network of air space-containing material, which allows the free flow of gases through it. In such a case, the shape of the duct itself need not be one that would allow free gas flow. In other words, there need not be a macroscopic passage. Free gas flow is instead maintained through a network of spaces in the fusible material. The shape of such ducts can be thin sheets for example. In the heat sealing process, the network is blocked by collapse and fusion of the material in the region of the heat seal.

In the inventive method of sealing a semi-rigid or non-rigid package, fusible duct material extends into the interior region of a package. The duct has internal and external ends. The internal end extends into the package interior, and the external end protrudes from the package. The extent of insertion depends on the relative filling of the package interior. The further into a package the internal end of the duct goes, the better vacuum is obtained. A package comprises at least two overlapping panels of package material. The panels can be separate sheets of material, or can be a single sheet folded over onto itself. The panels can be of any regular shape, for example, rectangular or circular, or of an irregular shape. The panels substantially overlap so that an interior region, isolated from fluid communication with the external environment, is capable of being formed after the heat sealing operation is completed.

The vacuum- and heat-sealing method according to the invention involves the placement of fusible duct material in at least a portion of the periphery of the package panels prior to the final heat sealing step. The relative amount of the periphery which can be provided with duct material varies continuously, from a very low percentage of the periphery to the entire periphery.

For example, in one embodiment of the invention, the package is substantially, but not entirely closed by fluid-tight seals prior to the vacuum application and final heat sealing. Such prior-formed seals can be formed by heat sealing the periphery or any other known method of forming a fluid-tight seal between two panels of package material. If the panels form a package by folding a single sheet of material onto itself, the folded edge need not be sealed. The portion of the periphery which is not sealed prior to the evacuation of the package interior is desirably completely occupied with fusible duct material. Thus, it is considered undesirable for a portion of the unsealed periphery to lack a duct, or for the duct to incompletely fill such portion of the periphery. This situation can lead to leakage and inefficient evacuation of the interior of the package. This undesirable situation could also lead to loss of material, such as granular material, from the interior of the package during evacuation.

The above-described embodiment is shown in FIG. 1. Package 1 is prepared for evacuation, and comprises upper package panel 2, and lower package panel 4. The periphery of these panels is substantially sealed with fluid-tight seal 6. Unsealed portion of the periphery 7 is occupied by duct 8, which extends from the outside of the package to interior region 10 of the package. In this particular embodiment, interior region 10 contains granular material 12. To complete fluid-tight seal 6 so that the entire periphery is sealed, and interior region 10 is isolated from fluid communication with the outside of the package, vacuum is applied and heat sealing carried out on unsealed portion of periphery 7, as described below. In FIG. 1, the granular material is depicted as substantially evenly distributed throughout the package interior, although the granular material can also be unevenly distributed throughout the package interior, for example substantially concentrated in a corner, or along a peripheral margin of the package interior. Similarly, although FIG. 1 depicts the duct extending a short distance into the package interior, in some embodiments, the duct material will extend completely into the package interior, for example into a corner, or potentially extending into the entirety of the package interior. Such variations do not at all affect the operation of the methods or materials described herein.

In another embodiment without prior-formed package seals, the periphery of the package panels includes fusible duct material disposed along the entire periphery of the package panels. Thus, in this limiting case, the entire fluid-tight seal along the periphery of the package is formed during the application of vacuum and concurrent heat sealing, and the entire periphery is sealed with fusible duct material forming a portion of the seal.

Figure 2:
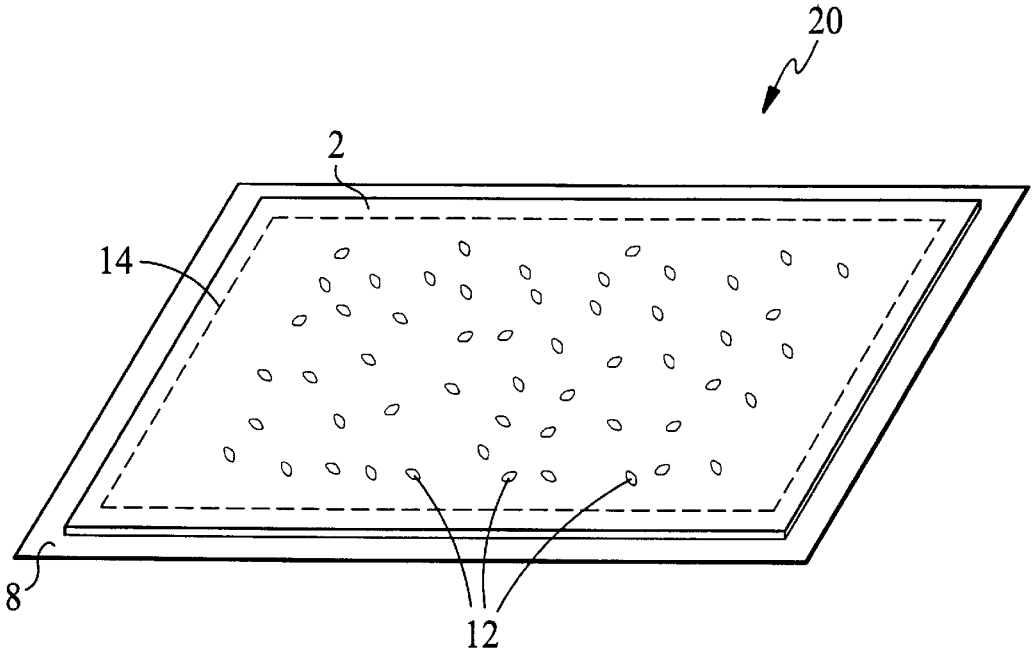
FIG. 2 is a perspective view of an unsealed package equipped with a vacuum packaging aid according to a particular embodiment of the invention.

FIG. 2 shows a particular embodiment according to the invention as described immediately above. Package 20 has upper panel 2 and lower panel 4 (not shown) as before. Duct 8 extends along the entire periphery of the panels, but has an internal boundary 14, so that it has a gasket-like shape. Granular particles 12 are present in this particular embodiment.

Figure 3:
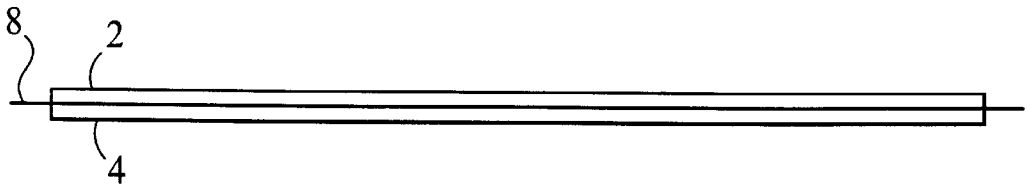
FIG. 3 is an edge-on view of the particular embodiment of the invention shown in FIG. 2.

FIG. 3 shows an edge-on view of the same package 20, with granular particles 12 omitted for clarity. In this view, lower panel 4 is visible.

Any amount of the periphery, such as 50% for example, can be sealed in the vacuum application/heat sealing step. However, any peripheral region not provided with duct material must be presealed with a fluid-tight seal.

The requirement that the fusible duct material form part of the package seal is met by a material which can melt at or below a temperature used to heat seal the package itself. The duct material can comprise a fabric, open cell foam, or a paper-like fiber sheet. Woven or non-woven materials can be used. A suitable material is polyethylene open cell foam. Another suitable material is Nalgene Polypaper. Another suitable material is known as interfacing, and is available as a sewing product. One example is sold under the trade name "Stitch Witchery" (HTC-Handler Textile Corp., Secaucus, N.J.).

Heat sealing is a variation on the related technique of "heated-tool welding." In heat sealing, the material to be sealed is lapped as desired. Heat is provided through the material, fusing the lapped portion.

There are generally two types of equipment used for heat sealing: high-frequency generators making use of the dielectric characteristics of the material to develop heat internally, and electrical-resistance elements that heat rollers, jaws, clamps for external heat application. Essential is equipment which provides control over the amount of heat deposited, the rate of heating, pressure applied, and area heated, so that acceptably strong seals are made, and so that the material is not degraded.

Package materials which can be sealed with heat include polymeric films or sheets of varying thickness. Some materials are inherently heat-sealable, and others (such as cellophane and some polyester films) can be made heat-sealable by coating them with heat-sealable polymers. Other materials do not soften effectively below the decomposition temperature and cannot be directly welded (for example, tetrafluoroethylene polymer and chlorotrifluoroethylene polymer), but can be welded if used with a flux, such as a fluorocarbon oil. Other materials are thermally degraded by attempts to heat seal them (for example, cellulose nitrate), and cannot be heat-sealed or made to be heat sealed. Suitable materials include conventional polyethylene bags, bags formed from SURLYN thermoplastic ionomer-lined multilayer film, flexible vinyl sheet, and many other materials. Any meltable plastics which combine to form a usable bond can be employed.

Temperatures which can be used to effectively heat seal various selected materials are given in Table 1.

TABLE 1

Heat-Sealing Temperatures for Plastic Films

| Film | Temp. ° C. |
|---|---|
| coated cellophane | 95–180 |
| cellulose acetate | 205–260 |
| coated polyester | 255 |
| poly (chlorotrifluoroethylene) | 215–235 |
| polyethylene | 125–195 |
| polystyrene (oriented) | 105–150 |
| poly (vinyl alcohol) | 150–205 |
| poly (vinyl chloride) and copolymers (nonrigid) | 95–205 |
| poly (vinyl chloride) and copolymers (rigid) | 130–205 |
| poly (vinyl chloride)-nitrile rubber blend | 105–180 |
| poly (vinylidene chloride) | 145 |

TABLE 1-continued

Heat-Sealing Temperatures for Plastic Films

| Film | Temp. ° C. |
|---|---|
| rubber hydrochloride | 110–180 |
| fluorinated ethylene-propylene copolymer | 320–400 |

In order to achieve a vacuum seal of the package, the interior of the package must be exposed to a vacuum as the heat seal is applied to the unsealed portions of the periphery of the package panels. As previously mentioned, the application of vacuum and the sealing and isolation of the interior region of the package can involve only a small portion of the periphery, or the entire periphery, or any variation between these limits.

The application of vacuum can be carried out by either coupling a vacuum source to the duct material directly, or by placing the area to be sealed (possibly the entire package) within a vacuum chamber. The former method is most applicable when much of the package periphery is sealed prior to evacuation and final heat sealing. For example, a vacuum nozzle or other vacuum source can be employed to apply vacuum to the duct material, and the duct material inserted into the package. The nozzle itself can extend partially into the package, whereas the duct material can effectively extend the evacuating power of the nozzle or other vacuum source.

The method of placing the area to be sealed within a vacuum chamber is most suitable when an entire edge of the package, or much of the periphery, is provided with duct material. Such methods are exemplified by the methods disclosed in U.S. Pat. No. 4,941,310 to Kristen.

Particular packages which can be sealed according to the methods and materials described herein include any which can usefully be sealed with heat, and which are conveniently evacuated without risk of losing material during the evacuation and sealing process. Particularly, granular or particulate material could be at risk of being removed from the package during evacuation. For example, a heat or cold pack, which includes a number of different zones which are initially isolated from each other, each zone containing a reagent which can react or interact with the contents of another zone of the heat or cold pack, can be evacuated and sealed with the methods and materials described herein. Such heat packs are described, for example, in U.S. Pat. Nos. 6,116,231; 5,984,953; and 5,035,230, which are incorporated herein in their entireties. Evacuation of a zone containing oxidizing agent in such heat packs can be carried out according to the methods and with the materials described herein, for example.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A method of creating an evacuated package, the method comprising:

providing a semi-rigid or non-rigid package comprising an upper panel and a lower panel of heat-sealable material between which is an interior region, said package being peripherally sealed except for a peripheral region traversed by a duct comprising fusible material having a network of air spaces permitting the flow of gases therethrough, said duct comprising an internal portion extending between said panels into the interior region of the package and an external portion outside the package and being in association with a vacuum source external to the package;

evacuating the interior region of the package by applying vacuum to the external portion of the duct; and heat sealing the unsealed region of the periphery of the package without removing the duct to collapse said network and fuse the same to said panels, thereby completing a fluid-tight barrier between the interior region of the package and the external environment.

2. The method of claim 1, wherein the unsealed package has a fluid tight seal around between about 50 and 99% of its periphery.

3. The method of claim 2, wherein the unsealed package has a fluid-tight seal around between about 75 and 99% of its periphery.

4. The method of claim 1, wherein the fusible material is selected from the group consisting of woven or non-woven fabric, open cell foam, paper, and fiber sheet.

5. The method of claim 1, wherein the interior region of the package is at least partially filled with granular material and said duct prevents loss of said granular material during the evacuation step.

6. The method of claim 1, wherein the package is made from a material selected from the group consisting of coated cellophane, cellulose acetate, coated polyester, poly (chlorotrifluoroethylene), polyethylene, polystyrene, polyvinyl alcohol, nonrigid polyvinyl chloride and copolymers thereof, polyvinyl chloride-nitrile rubber blend, polyvinylidene chloride, rubber hydrochloride, fluorinated ethylene-propylene copolymer, flexible vinyl, and thermoplastic ionomer-lined multi-layer film.

7. A method of creating an evacuated package, the method comprising:

providing a semi-rigid or non-rigid package with a duct, wherein the package comprises an upper heat-sealable panel and a lower heat-sealable panel between which is an interior region, said panels being peripherally sealed to one another to form a fluid-tight barrier between the interior region and the external environment that is complete except for an unsealed peripheral region occupied by said duct, and wherein the duct comprises a fusible sheet having a network of air spaces permitting the flow of gases therethrough, said sheet being resistant to vacuum-induced collapse and having an internal portion inserted between said panels into the interior region of the package and an external portion being external to the package and in association with a vacuum source external to the package;

drawing a vacuum on the interior region of the package by applying vacuum on the external portion of the sheet; and applying heat to the unsealed peripheral region of the package, so that the sheet fuses and forms at least part of the completed fluid-tight barrier between the interior region of the package and the external environment.

* * * * *